US005783987A

United States Patent [19]

Kern et al.

[11] Patent Number: 5,783,987

[45] Date of Patent: Jul. 21, 1998

[54] PYROTECHNIC HIGH-CURRENT SAFETY FUSE ELEMENT

[75] Inventors: Heinz Kern, Furth; Gerhard Kordel, Nuremberg, both of Germany

[73] Assignee: Dynamit Nobel Aktiengesellschaft, Troisdorf, Germany

[21] Appl. No.: 494,571

[22] Filed: Jun. 22, 1995

[30] Foreign Application Priority Data

Jun. 28, 1994 [DE] Germany ..... 44 22 177.0

[51] Int. Cl.[6] ..... H01H 37/76; H01H 85/00

[52] U.S. Cl. ..... 337/401; 337/4; 337/403

[58] Field of Search ..... 337/4, 400–407; 200/61.08; 361/103

[56] References Cited

U.S. PATENT DOCUMENTS 4,460,886 7/1984 Jarosz et al. .
4,467,307 8/1984 Jackson .
4,691,085 9/1987 Swanson .
5,014,036 5/1991 Komoto ..... 337/407

FOREIGN PATENT DOCUMENTS 0243076 10/1987 European Pat. Off. .
0563947 10/1993 European Pat. Off. .
94 01 486.8 5/1994 Germany .

*Primary Examiner*—Leo P. Picard
*Assistant Examiner*—Jayprakash N. Gandhi
*Attorney, Agent, or Firm*—Antonelli, Terry, Stout, & Kraus, LLP

[57] ABSTRACT

A pyrotechnic high-current fuse element in which a current conductor located in a circuit to be protected is interrupted or displaced by ignition of a pyrotechnic charge when the current strength in the circuit exceeds a threshold value includes a separate component that can be installed in the circuit to be protected, to which component the ends of a current conductor to be cut are connected.

10 Claims, 2 Drawing Sheets

FIG. 1
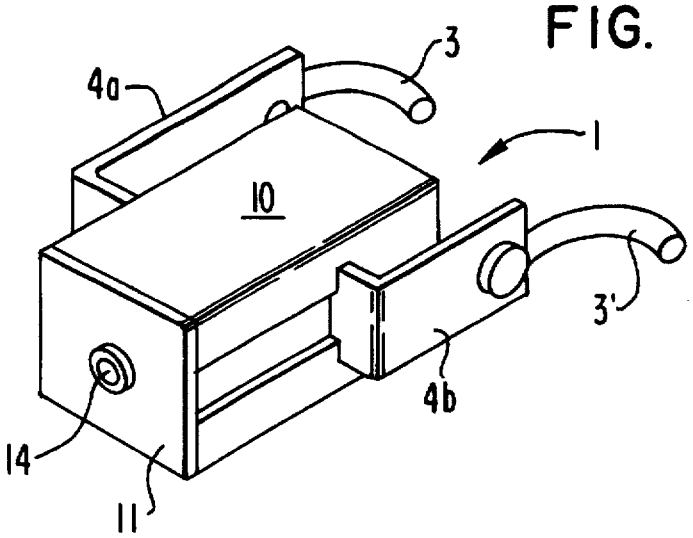
FIG. 2a
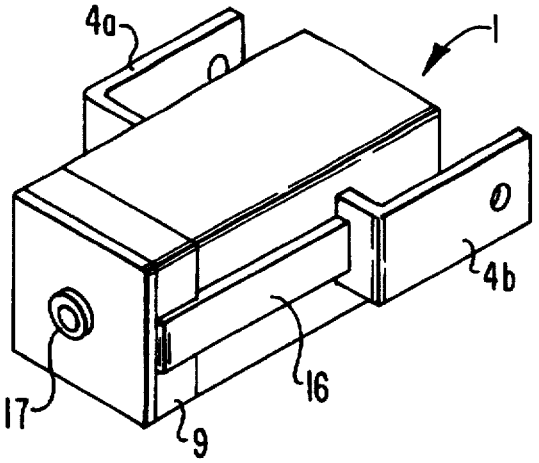
FIG. 2b
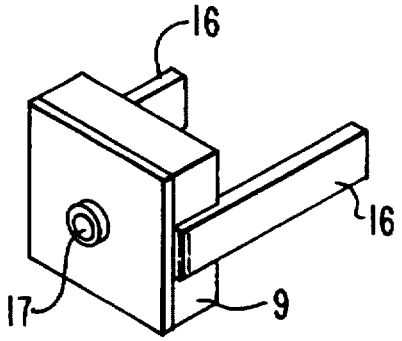
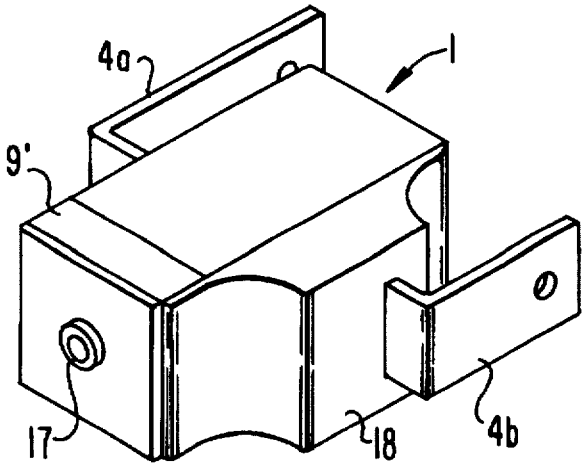
FIG. 3a
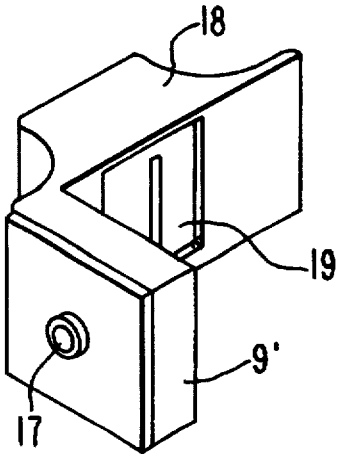
FIG. 3b

PYROTECHNIC HIGH-CURRENT SAFETY FUSE ELEMENT

FIELD OF INVENTION

This invention relates to a pyrotechnic high-current fuse element having a current conductor in a circuit to be protected which is interrupted by ignition of a pyrotechnic charge when current strength in the circuit exceeds a threshold value.

BACKGROUND OF THE INVENTION

Protection of electrical consumers against excess currents resulting, for example, from short circuits, overloads, or the like is accomplished by, among other methods, fusible elements specially calibrated for individual applications. These fusible elements have a fusible conductor that is wired into the circuit of the electrical consumer. The cross section and material of the fusible conductor are chosen so that it melts and is destroyed by electrical currents that are higher than a desired threshold value.

In the most favorable case, response times of only milliseconds can be achieved with conventional fusible elements, which can result in the destruction of the circuits to be protected. In addition, the diversity of types of fusible elements that must be provided is also a problem since a specific response characteristic must be provided for each application and hence a specific design is required.

DE 42 11 079 A1 teaches a method for protection of circuits, especially circuits carrying high currents, against excess current, as well as a high-current fuse element in which the strength of the current flowing through the current conductor is determined and the conductor is destroyed by igniting a pyrotechnic charge if the current strength exceeds the threshold value. For this purpose, a cutting element is accelerated by the ignition of the pyrotechnic charge in such fashion that it severs the current conductor.

SUMMARY OF THE INVENTION

An object of the invention is to provide a pyrotechnic high-current fuse element exhibiting universal applicability with a simple design. In addition, ultra-short breaking times are to be achieved.

This object is achieved by a high-current fuse element comprising a separate component that can be inserted into the circuit to be protected and to which conductors to be separated are connected.

Designing the high-current fuse element as a separate component ensures universal applicability. The current conductors to be monitored merely need to be severed and the severed ends of the conductor connected to the high-current fuse element. The shape and thickness of the current conductor are immaterial in this regard.

The term "high-current fuse element" is intended to convey the meaning that when a preset threshold value is exceeded, the circuit is shut off (broken). High current therefore is viewed here as relative to continuous current flowing through the current conductor.

One preferred embodiment of the invention is characterized by the fact that the high-current fuse element comprises two buses overlapping at their ends with a gap between them, said buses being connected in an electrically conducting manner with one another in a housing comprising a dielectric material by a contact pin that bridges the gap, and the contact pin is moved from the contact or closed position into a position (open or broken position) that interrupts the flow of current upon the ignition of the pyrotechnic charge. This ensures a simple design for the high-current fuse element. In addition, the safety of the separation with simultaneous ultra-short severing times is ensured. The high-current fuse element according to the invention can achieve severing times in the range from 150 to 300 microseconds.

According to the invention, the contact pin is accommodated with a press fit in holes that penetrates the two buses. This provides a good electrical connection for the two buses. In addition, the connection is mechanically stable. Copper is preferably suited as the material for the buses and the contact pin. However, other metals or metal compounds such as aluminum or brass are also suitable.

Advantageously the contact pin has a knurl in the vicinity of the contact with the two buses. This creates a plurality of individual small and defined contact areas to ensure a good electrical contact.

According to the invention, an insulating punch or plug is disposed advantageously in the axial direction in a bore or hole abutting the contact pin, with the pressure from the ignited pyrotechnic charge acting on the contact pin through the insulating punch. In a preferred embodiment, the diameter of the contact pin is equal to the diameter of the insulating punch. This has the advantage that after the pyrotechnic charge has ignited, the insulating punch pushes the contact pin out of its contact or closed position into an open or broken position and thereby advantageously assumes nearly the contact position of the contact pin. If the diameter of the insulating punch is equal to that of the contact pin, after the pyrotechnic charge has ignited the insulating punch is accommodated with a press fit in the uppermost bus. It is important in this connection that the insulating punch, after ignition has occurred, be connected permanently with at least one of the buses so that the initial state cannot be restored. This is a significant safety aspect.

The insulating punch can be made slightly conical to form this permanent connection. It is sufficient for the end of the insulating punch facing away from the uppermost bus to be made slightly conical.

In a preferred embodiment, the contact pin, insulating punch, and holes in the buses are located in a hole or bore in the housing. The pyrotechnic charge advantageously forms the plug in the bore in the housing. This creates a hermetically sealed space.

When high currents are disconnected, an arc usually forms between the ends of the break. In the high-current fuse element presented here, the gas pressure of the pyrotechnic charge counteracts the creation of an arc (Paschen's Law).

To equalize the pressure, the hole in the housing is provided with a vent hole at the end that accommodates the contact pin in the open or broken position. Advantageously, the vent hole is sealed externally by a visible plug which is expelled or destroyed when the compressed gases escape and thus functions as an indicator. However, other forms of indicator may be used.

In a preferred embodiment, ignition elements like those used, for example, in compressed gas generators for airbags may be used as the pyrotechnic charge.

In one preferred embodiment, a triggering electronic circuit of conventional design is integrated into the high-current fuse element, said circuit automatically initiating the ignition of the pyrotechnic charge when the current through the high-current fuse element exceeds a preset threshold value.

Advantageously, the triggering electronic circuit is mounted in the form of a module on the high-current fuse element.

BRIEF DESCRIPTION OF THE DRAWINGS

Further features will be evident from the accompanying drawings hereinafter described in detail wherein:

FIG. 1 is a perspective view of the high-current fuse element according to the invention;

FIGS. 2*a* and 2*b* show the high-current fuse element according to FIG. 1 with the triggering electronic circuit mounted for direct current (FIG. 2*a*) and with the modular triggering electronic circuit alone (FIG. 2*b*);

FIGS. 3*a* and 3*b* show another embodiment of the high-current fuse element according to FIG. 1 with another triggering electronic circuit mounted for alternating current (FIG. 3*a*) and a modular triggering electronic circuit alone (FIG. 3*b*);

DETAILED DESCRIPTION OF THE INVENTION

Figure 4:
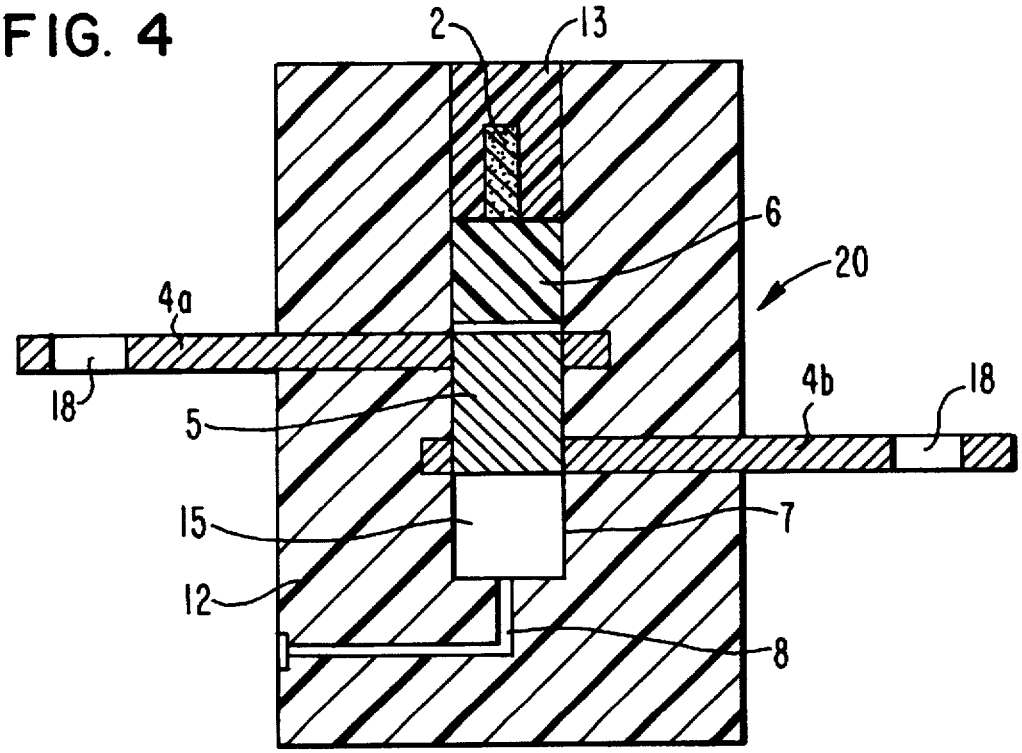
FIG. 4 is a cross-section through a pyrotechnic separating device within the high-current fuse element before triggering.

FIG. 1 shows one embodiment of a high-current fuse element 1 according to the invention. High-current fuse element 1 consists of an outer casing or shell from which two buses 4*a*, 4*b* project. Current conductors 3,3' of a circuit to be protected are attached to these buses 4*a*, 4*b*. A bushing 14 is mounted centrally on end cover 11 of casing 10, said bushing being connectable with a triggering electronic circuit not shown in this figure. A pyrotechnic separating device is disposed inside casing 10, said device breaking the electrically conducting connection of the two buses 4*a*, 4*b*, i.e. interrupting it, upon a signal from the triggering electronic circuit.

Before describing the particular design and arrangement of the triggering electronic circuit according to FIGS. 2*a*, 2*b* 3*a* and 3*b*, the internal construction of the high-current fuse element 1 will be described with reference to FIGS. 4 and 5.

FIG. 4 shows in a section the pyrotechnic separating device of the high-current fuse element 1 before triggering. This device is inserted into casing 10. A hole 7 in the housing 20 of this device is provided as a blind hole in a block 12 made of a material which is not a conductor of electricity, e.g., a dielectric material such as a plastic. Housing hole 7 is sealed at its open end by a sealing element 13. Sealing element 13 can be glued, clamped, or welded in place, for example. A pyrotechnic charge 2 or a triggering element is placed in sealing element 13. Upon ignition, pyrotechnic charge 2 generates a compressed gas. Pyrotechnic charge 2 is connected by a connection, not shown, with bushing 14 on cover 11 (see FIG. 1) of the high-current fuse element.

Two buses 4*a*, 4*b* are provided in block 12, the buses penetrating housing hole 7 and being arranged one above the other with a space between them. The spacing of the two buses 4*a*, 4*b* from one another is made sufficiently large that voltage flashover after separation has occurred is prevented. One hole is provided in each of the two buses 4*a* and 4*b*, said hole matching the diameter of housing hole 7, with these holes forming a part of the wall of housing hole 7.

The two buses 4*a*, 4*b* are connected in an electrically conducting fashion by a conducting contact pin 5, accommodated with a press fit both in upper bus 4*a* and in lower bus 4*b*. The length of contact pin 5 is equal to the distance of the two buses 4*a*, 4*b* from one another plus the thickness of the two buses 4*a*, 4*b*. In the area of contact with buses 4*a*, 4*b* contact pin 5 has a knurl, not shown, so that, as defined, a plurality of small contact points is provided that produce and guarantee uniform current distribution.

An insulating punch 6 made of a material which is not an electrical conductor is provided between contact pin 5 and pyrotechnic charge 2. The punch is made of, for example, glass fiber or a hard plastic. Insulating punch 6 has the same diameter as contact pin 5. Its length is reduced by the thickness of one bus 4*b* relative to the length of contact pin 5. Below the contact pin 5 is a receptacle 15 in housing hole 7 to receive contact pin 5 after pyrotechnic charge 2 has been ignited. The length of receptacle 15 is chosen so that after ignition has occurred, contact pin 5 rests on the lower end of housing hole 7 and has its other end still in lower bus 4*b* (see FIG. 5).

To relieve the pressure, housing hole 7 is provided on its underside with a vent hole 8 that preferably leads to the atmosphere through a bend, i.e. a bent portion. Vent hole 8 is advantageously sealed from the exterior by a plug, not shown, said plug being expelled or destroyed by the pressure surge upon ignition, and thus functioning as an indicator or marker. An opening in casing 10 (not shown) is provided to coincide with the vent hole 8.

The ends of buses 4*a*, 4*b* are provided with holes 18 so that conductors 3,3' (see FIG. 1) can be easily fastened, e.g. by a screw connection.

Upon the ignition of pyrotechnic charge 2, a compressed gas is generated that exerts a force on the upper end of insulating punch 6, so that the punch is accelerated in the direction of contact pin 5. As a result of the force acting through insulating punch 6, contact pin 5 is pushed from its press fit in the hole of buses 4*a*, 4*b* and enters receptacle 15.

Figure 5:
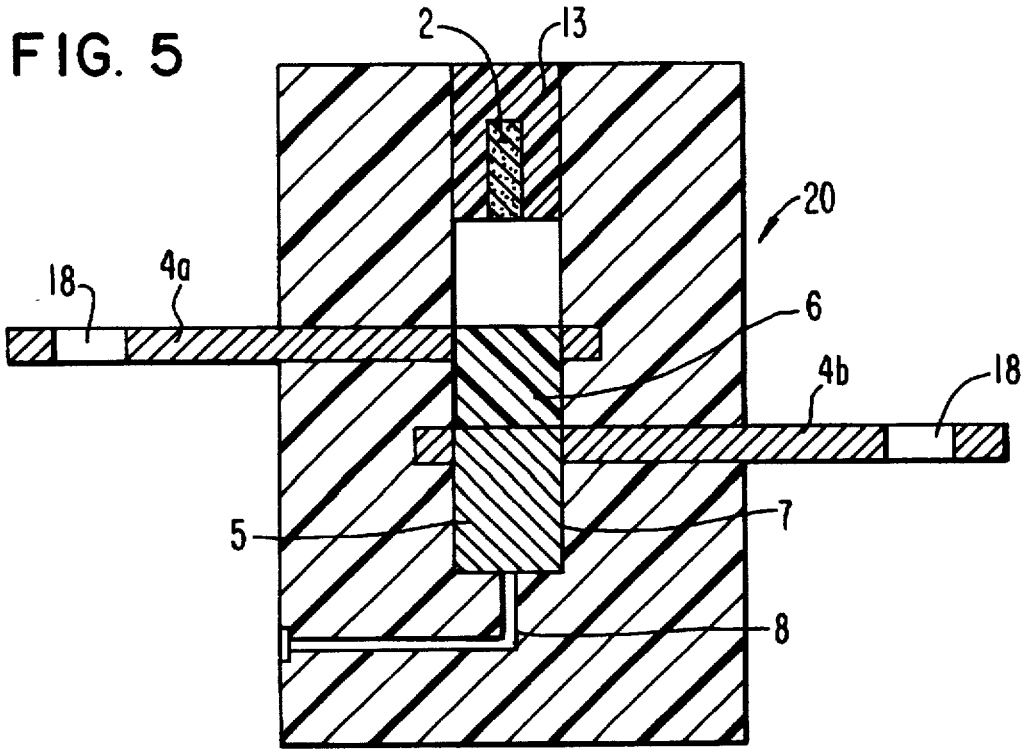
FIG. 5 is a cross-section through a pyrotechnic separating device within the high-current fuse element after triggering.

FIG. 5 shows a section through the high-current fuse element following triggering. Contact pin 5 rests on the bottom of housing hole 7 and has its other end still in lower bus 4*b*. The term "up" refers to the direction of pyrotechnic charge 2 and the term "down" refers to the direction of vent hole 8.

Insulating punch 6, after ignition occurs, occupies nearly the original position (contact position) of contact pin 5, with insulating punch 6 abutting lower bus 4*b*, but not projecting into the hole in bus 4*b*. A plug mounted externally on vent hole 8 is expelled or destroyed by the pressure of the escaping gas, so that it is evident from the outside that ignition has occurred.

FIG. 2*a* shows high-current fuse element 1 with a triggering electronic circuit 9 mounted for direct current. FIG. 2*b* shows triggering electronic circuit 9 alone. A plug (not shown) is provided on the underside of triggering electronic circuit 9, said plug being inserted into bushing 14 (see FIG. 1). Two metal strips 16 extend from triggering electronic circuit 9 to buses 4*a*, 4*b* and are in electrical contact therewith. Advantageously, strips 16 have a pin that projects into a depression in the respective bus so that an improved electrical contact is produced. On the top of triggering electronic circuit 9, a bushing 17 is provided by which the high-current fuse element can be ignited from the outside as well. The triggering electronic circuit shown in FIGS. 2*a* and 2*b* is intended for direct current. The voltage drop between the two buses 4*a*, 4*b* is measured by the two taps 16. If a predetermined value is exceeded, triggering electronic circuit 9 ignites pyrotechnic charge 2 through bushing 14 (see FIG. 1). It can also be advantageous not to provide cover 11 with bushing 14 and instead to mount the triggering electronic circuit 9 directly on housing 10.

FIG. 3*a* and 3*b* show a triggering electronic circuit 9' for alternating current. This triggering electronic circuit 9', as shown in FIGS. 3*a* and 3*b*, is also mounted as a module on the basic module shown in FIG. 1. With alternating current, the level of an induced current is measured. For this purpose, a coil 19 or a AC transformer is mounted laterally on triggering electronic circuit 9' in a box 18. Coil 19 surrounds one of the buses. The current induced in coil 19 is evaluated in triggering electronic circuit 9' and if a predetermined value is exceeded, the pyrotechnic charge is triggered through bushing 14 (see FIG. 1). At the same time, the alternating current induced in coil 19 serves to supply voltage to the triggering electronic circuit. The electronic circuits 9 and 9' consist of standard elements of conventional construction.

What we claim is:

1. A pyrotechnic high-current fuse element for interrupting a flow of current in a current conductor located in a circuit to be protected by ignition of a pyrotechnic charge when the current strength in the circuit exceeds a threshold value, said high-current fuse element being a separate component that can be installed in the circuit to be protected, and comprising two buses overlapping one another at first ends with a gap therebetween; a conducting contact pin connecting said buses in an electrically conducting manner with one another by bridging the gap, said contact pin being moved into an open position by the ignition of pyrotechnic charge from a contact or closed position, second ends of said buses being adapted to be connected to the ends of the current conductor; and an insulating punch provided in a housing hole of a housing and abutting the contact pin, a force of the pressure from ignited pyrotechnic charge being transmitted to the contact pin through the insulating punch, wherein the insulating punch nearly adopts the contact position of the contact pin after pyrotechnic charge has been ignited.

2. The high-current fuse element according to claim 1, wherein the contact pin is accommodated with a press fit in holes penetrating the two buses.

3. The high-current fuse element according to claim 1, wherein the diameter of contact pin is equal to the diameter of insulating punch.

4. The high-current fuse element according to claim 1, wherein the contact pin has a knurl in the vicinity of the contact with the two buses.

5. The high-current fuse element according to claim 1, wherein the contact pin, insulating punch and the holes in buses are in alignment with the hole in the housing.

6. The high-current fuse element according to claim 4, wherein housing hole is provided with a vent hole in an end that receives contact pin in the open position.

7. The high-current fuse element according to claim 5, wherein vent hole is closed by a plug that is expelled or destroyed when the compressed gas escapes, thereby acting as an indicator.

8. The high-current fuse element according to claim 6, wherein a triggering electronic circuit is integrated into high-current fuse element, said circuit automatically initiating the ignition of pyrotechnic charge when the current through high-current fuse element exceeds a preset threshold value.

9. The high-current fuse element according to claim 7, wherein the triggering electronic circuit is mounted as a module on a casing of said high-current fuse element.

10. The high-current fuse element according to claim 9, wherein the casing is made of a dielectric material.

* * * * *